United States Patent [19]

Kollodzeiski et al.

[11] 4,252,535

[45] Feb. 24, 1981

[54] PROCESS FOR DYEING UNIFORMLY POLYACRYLONITRILE FIBER MATERIALS

[75] Inventors: Norbert Kollodzeiski, Eppstein; Rudolf Löwenfeld, Dreieich; Eberhard Mundlos, Heusenstamm; Reinhard Mohr, Offenbach am Main; Kurt Hohmann, Neu-Isenburg, all of Fed. Rep. of Germany

[73] Assignee: Hoechst Aktiengesellschaft, Fed. Rep. of Germany

[21] Appl. No.: 16,300

[22] Filed: Feb. 28, 1979

Related U.S. Application Data

[63] Continuation of Ser. No. 894,990, Mar. 10, 1978, abandoned.

[30] Foreign Application Priority Data

Apr. 13, 1977 [DE] Fed. Rep. of Germany ..... 2716246

[51] Int. Cl.[3] ..... D06P 3/70; C09B 27/00

[52] U.S. Cl. ..... 8/639; 8/644; 8/927

[58] Field of Search ..... 8/41 A, 26, 177 AB, 8/639, 644, 927

[56] References Cited

U.S. PATENT DOCUMENTS

| | | | |
|---|---|---|---|
| 2,906,747 | 9/1959 | Wolfrum | 8/50 |
| 3,042,648 | 7/1962 | Lewis | 8/41 R |
| 4,181,499 | 1/1980 | Koller et al. | 8/644 |

FOREIGN PATENT DOCUMENTS

| | | |
|---|---|---|
| 2548009 | 5/1976 | Fed. Rep. of Germany . |
| 1092828 | 4/1955 | France . |

OTHER PUBLICATIONS

Venkataraman; K., "The Chemistry of Synthetic Dyes", vol. IV, (Academic Press), 1971, pp. 161–165, 206–208.

Colour Index, vol. 4 (Third Edition), 1971, p. 4019, C.I. 11270.

*Primary Examiner*—A. Lionel Clingman

*Attorney, Agent, or Firm*—Connolly and Hutz

[57] ABSTRACT

A dyeing process has been found which enables to dye uniformly polyacrylonitrile fiber materials, by using as dyestuffs basic azo dyestuffs being non-quarternized and containing neither cationic quaternary ammonium groups nor cationic N-substituted or N-unsubstituted iminium groups, said azo dyestuffs containing on the other hand at least one unsubstituted or substituted amino group, hydrazino group, amidino group or guanidino group capable of forming salts. The very dyeing process as such is carried out according to usual processing data for dyeing polyacrylonitriles in a slightly acid medium. Especially with the use of several of these dyestuffs for polychromic dyeing, such as trichromic dyeing, special advantages are obtained, insofar that even at cut-rate dyeing periods and for preparing light color shades, there are obtained even dyes with constant color shades, when using these dyestuffs having good migrating properties.

6 Claims, No Drawings

PROCESS FOR DYEING UNIFORMLY POLYACRYLONITRILE FIBER MATERIALS

This application is a continuation of application Ser. No. 894,990 filed on Mar. 10, 1978 now abandoned.

It is known from German Offenlegungsschrift 2 548 009, that fiber materials of polyacrylonitrile with differring affinities, i.e. polyacrylonitrile fiber materials with fast (high), slow (small) and normal (medium) affinity, may be dyed uniformly with the use of mixtures of specifically selected cationic dyestuffs, the dyestuff cations of which have a delocalized positive charge. These dyestuffs are characterized preferably by a cationic weight of less than 275, by a parachor of less than 680 and by a log P-value of less than 2.8. Especially good results in trichromic dyeing are obtained with the use of a dyestuff mixture comprising the red dyestuff having formula (A)

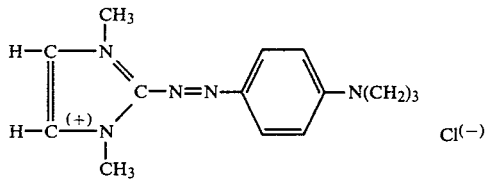

(A)

the blue dyestuff having formula (B)

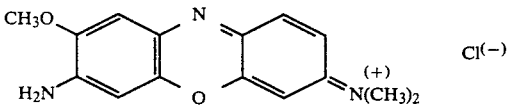

(B)

and the yellow dyestuff having formula (C)

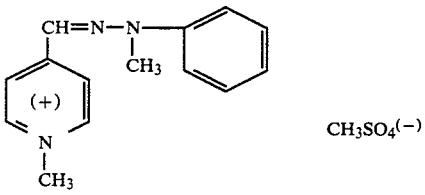

(C)

An important factor for choosing these cationic dyestuffs for use in polychromic dyeing were their excellent migrating properties.

It has now been found that non-quaternized basic azo dyestuffs which do not contain any cationic quaternary ammonium group or cationic N-substituted or N-unsubstituted iminium group, but which contain at least one, such as 1, 2 or 3, unsubstituted or substituted amino, hydrazino, amidino or guanidino group each capable of forming a salt, are migrating dyestuffs and very well suited as well to dyeing uniformly fiber materials of polyacrylonitrile or copolymers thereof, having differring affinity properties.

Thus, the present invention represents a process for dyeing uniformly fibrous materials of polyacrylonitrile, preferably having differring affinity properties, wherein a nonquaternized basic azo dyestuff containing no cationic quaternary ammonium group or cationic N-substituted or N-unsubstituted iminium group, but containing on the other hand at least one unsubstituted or substituted amino group, hydrazino, amidino or guanidino group, each capable of forming a salt, is used. This process is preferably carried out with the use of these dyestuffs in polychromic and especially trichromic dyeing methods.

The dyestuffs preferably used in the process of the invention contain the amino group, hydrazino group, amidino group or guanidino group preferably linked to a phenyl radical or a heterocyclic radical of the dyestuff chromophore. Special attention is brought to the dyestuffs having formulae (I), (II) and (III)

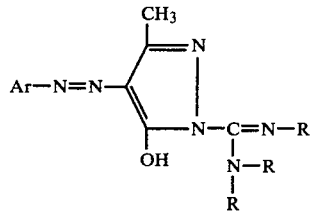

(I)

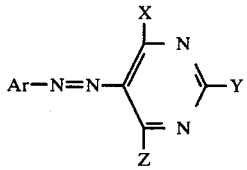

(II)

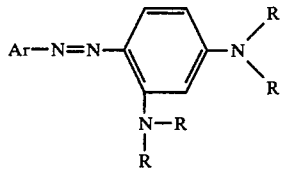

(III)

The structural units of these dyestuff-formulae have the following meanings:

Ar is a phenyl radical that may be substituted by one or two substituents of the group chlorine, bromine, methyl, methoxy and ethoxy, R, being identical or different, preferably identical, are each hydrogen, methyl or ethyl, X, Y and Z, being identical or different, each being a group having formulae

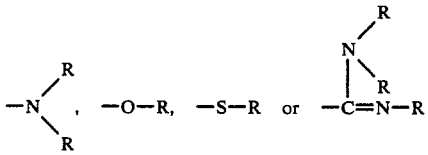

wherein R has the above mentioned meaning.

Among the dyestuffs having formulae (I), (II) and (III) a particularly advantageous coloring behaviour is displayed by those, wherein Ar stands for a phenyl, methylphenyl, methoxyphenyl, chlorophenyl, or methylmethoxyphenyl group and wherein R represents a hydrogen atom.

The basic dyestuffs used in the dyeing process of the invention are applied in form of their salts of an inorganic or organic acid; they may be added to the dyeing liquor or the dyebath either as salt from the start or as free base which is then converted to a salt thereof within the dyeing liquor (or dyebath) by means of the acid which is present in the dyeing liquor, preferably of an acid specifically used in the process for dyeing polyacrylonitrile fibers, such as acetic acid. Since polyacrylonitrile fiber materials are subjected to dyeing in a slightly acid medium, as it is also the case for the process of the present invention, the dyestuffs used for this process are usually present in the dyeing liquor (the dyebath) as an equilibrated mixture of the base and the salt.

The present invention comprises, therefore, especially treating in usual manner a fibrous material of polyacrylonitrile with an aqueous, slightly acid solution of one or several of said basic azo dyestuffs, preferably at a pH of 3 to 6.5, especially of 4.5 to 6, and at a temperature of from 20° to 120° C., particularly advantageous at a temperature of from 80° to 108° C., especially 102° C.

The basic azo dyestuffs which are used according to the invention, are well suitable as single dyestuffs as well as in admixture to each other for dyeing polyacrylonitrile fibrous materials regardless of the affinity grade of these fibrous materials. They may especially be used for polychromic dyeing processes in combination with other migrating quaternary dyestuffs, especially with the dyestuffs described in German Offenlegungsschrift 2 548 009. They produce on these fibrous material, especially in the combination dyeing process, even colorations with a uniform color shade; the simultaneous application of electrolytes, such as sodium sulfate or sodium chloride, in quantities of from about 5 to 15%, calculated on the weight of the goods, in the dyeing liquor or in the dyebath, produces especially good results. Thus, uniform combination dyeings are not only obtained by a conventional dyeing method (slow heating), but with an equally advantageous outcome when remaining essentially independent from time- and temperature-conditions of the dyeing process. It is thus possible to dye rapidly, evenly and uniformly polyacrylontirile fiber materials with the basic azo dyestuffs used according to the invention,—either separately or also combined with the dyestuffs known from German Offenlegungsschrift No. 2 548 009—, advantageously in such a way that the fiber material is immersed into the dyeing bath having a temperature of about 80° C., and that dyeing takes place subsequently at boiling temperature; this method avoids an extended, complicated and costly heating phase. Since the basic azo dyestuffs according to the invention have an excellent migrating capacity, too, initially occuring uneven color shades are levelling out in course of the dyeing process at boiling temperature.

Especially advantageous is the process of the invention wherein dyestuffs of formulae (I), (II) and/or (III) are used in combination with the cationic dyestuffs of German Offenlegungsschrift No. 2 548 009, having a cation weight below 275, a parachor below 680 and a log P-value of below 2.8. The dyestuffs used according to the invention having the formulae (I), (II) and (III) may especially be combined with the dyestuffs of formulae (IV), (V) and/or (VI)

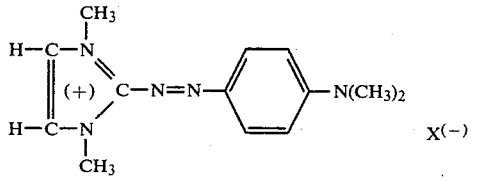

(IV)

-continued

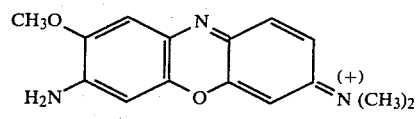

(V)

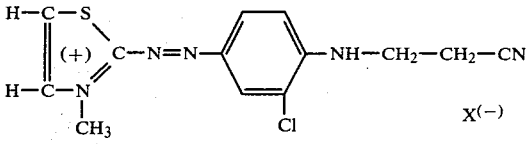

(VI)

wherein $X^{(-)}$ represents an anion of an inorganic or organic acid, preferably the chloride ion, sulfate ion, bisulfate ion, acetate ion, methosulfate ion, tetrachlorozincate ion, trichlorozincate ion or phosphate ion.

These novel combination possibilities provide further excellent applications in the fields of dichromic, trichromic, general polychromic dyeing, of polyacrylonitrile fiber materials.

In some cases, such as for preparing light color shades, the use of a commercially available retarding agent is advantageous for producing good results, without, however, being compulsory. Preference is given to the use of a migrating cationic retarding agent having a cation weight of below 310; preferably may be used as cationic retarding agent a compound of formula (IX) or (X)

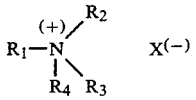

(IX)

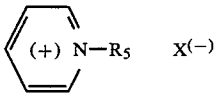

(X)

wherein $R_1$ represents an alkyl radical having from 6 to 14 carbon atoms, $R_2$, $R_3$ or $R_4$ may be identical or different from each other, and each may be an alkyl radical having 1 to 5 carbon atoms which may be substituted by a hydroxy group, $R_5$ stands for an alkyl radical with 8 to 15 carbon atoms and $X^{(-)}$ stands for an anion of an inorganic or organic acid.

The cationic retarding agent, if any, is used in quantities of from 0.1 to 1.5 weight %, calculated on the weight of the fiber goods to be dyed.

The following Examples illustrate the invention.

EXAMPLE 1

1 kg of yarn consisting of polyacrylonitrile fiber with normal affinity properties, is dyed in a circulation dyeing apparatus in 25 l of a dyeing liquor, as follows: The dyeing liquor contains in 25, l besides water, 10 g of acetic acid (60% strength)
20 g crystallized sodium acetate,
100 g of anhydrous sodium sulfate
1 g of dyestuff of formula (XI)

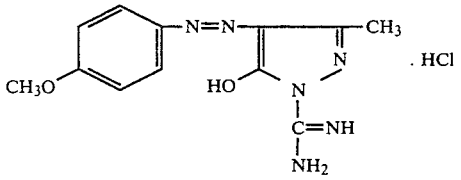

(XI)

0.19 g of the dyestuff of formula (XII)

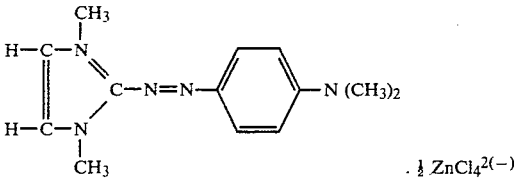

(XII)

0.007 g of the dyestuff of formula (XIII)

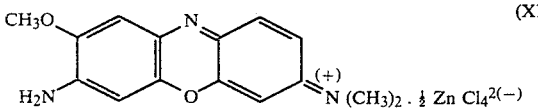

(XIII)

2.25 g of a reaction product of 2.5 mols of ethylene oxide with 1 mol of stearyl amine.

The polyacrylonitrile yarn is introduced into the dyebath having a temperature of 80° C. which is then heated to boiling temperature within 45 minutes with alternating circulation direction. The yarn is further dyed at boiling temperature for 30 to 65 minutes. The dyebath is then allowed to cool, the yarn is removed and rinsed as usual. The result is a perfectly even beige color shade.

EXAMPLES 2 to 8

If the process is carried out as described in Example 1, however with the use of a dyestuff mixture specified in the following Examples (Table 1) instead of the dyestuff mixture indicated in Example 1, the results are also dyeings of perfectly even and uniform color shades:

TABLE 1

| Example | quantity of dyestuff used | dyestuff having formula | shade of the dyeing obtained |
|---|---|---|---|
| 2 | 1.08 g | dyestuff (XIV) 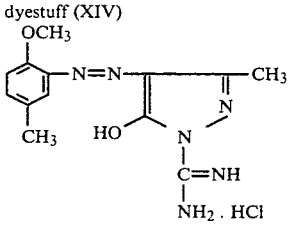 | green |
| | 0.035 g | dyestuff (XII) | |
| | 0.12 g | dyestuff (XIII) | |
| 3 | 0.38 g | dyestuff (XI) | grey |
| | 0.35 g | dyestuff (XII) | |

TABLE 1-continued

| Example | quantity of dyestuff used | dyestuff having formula | shade of the dyeing obtained |
|---|---|---|---|
| | 0.55 g | dyestuff (XIII) | |
| 4 | 0.51 g | dyestuff (XIV) | beige |
| | 0.028 g | dyestuff (XII) | |
| | 0.040 g | dyestuff (XIII) | |
| 5 | 2.85 g | dyestuff (XIV) | brown(*) |
| | 0.98 g | dyestuff (XII) | |
| | 0.062 g | dyestuff (XIII) | |
| 6 | 1.00 g | dyestuff (XV) 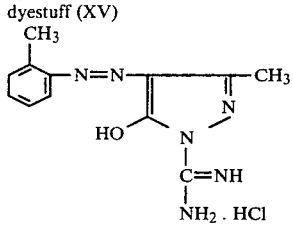 | beige |
| | 0.21 g | dyestuff (XII) | beige |
| | 0.009 g | dyestuff (XIII) | |
| 7 | 2.00 g | dyestuff (XVI) 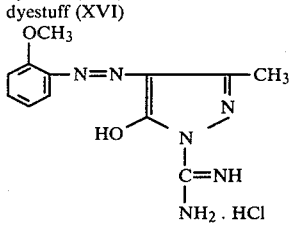 | green |
| | 0.11 g | dyestuff (XIII) | green |
| 8 | 3.00 g | dyestuff (XIV) | brown |
| | 1.19 g | dyestuff (XII) | |
| | 0.26 g | dyestuff (XIII) | |

(*)(good behavior under incandescent light conditions: only slight shift to red).

EXAMPLE 9

1 kg of yarn of polyacrylonitrile fiber with high affinity properties is dyed in a circulation dyeing apparatus in 25 l of dyebath which contained the following substances, besides water:

10 g of acetic acid (60% strength)
20 g crystal sodium acetate
100 g anhydrous sodium sulfate,
0.027 g of dyestuff of formula (XIV),
0.011 g of dyestuff of formula (XII),
0.007 g of dyestuff of formula (XIII).

The yarn is introduced into the dyeing bath having a temperature of 90° C., which is then heated to 106° C. within 30 minutes at alternating circulation direction. The yarn is dyed at 106° C. dyeing temperature for further 30 minutes the dyebath is then cooled, the dyed yarn is removed and rinsed as usual. A dyeing of an even and uniform beige color shade is obtained.

EXAMPLES 10 to 30

If the dyeing process is carried out according to the method described in Example 1 or Example 9, the dyestuffs specified therein being replaced, however, by a dyestuff mixture mentioned in the following Table 2 (Examples 10 to 30), dyeings are obtained which also show perfectly even and uniform shades as stated in Table 2.

TABLE 2

| Example | quantity of dyestuff used | dyestuff of formula | shade of the dyeing obtained |
|---|---|---|---|
| 10 | 7.00 g | dyestuff (XV) | blueish |

TABLE 2-continued

| Example | quantity of dyestuff used | dyestuff of formula | shade of the dyeing obtained |
|---|---|---|---|
| | 2.10 g | dyestuff (XII) | green |
| | 2.57 g | dyestuff (XIII) | |
| 11 | 1.50 g | dyestuff (XV) | dark |
| | 1.26 g | dyestuff (XII) | grey |
| | 2.20 g | dyestuff (XIII) | |
| 12 | 1.70 g | dyestuff (XI) | brown |
| | 2.10 g | dyestuff (XII) | |
| | 0.55 g | dyestuff (XIII) | |
| 13 | 1.70 g | dyestuff (XVII) | brown |
| | | 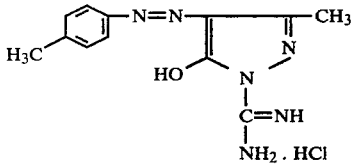 | |
| | 2.10 g | dyestuff (XII) | |
| | 0.55 g | dyestuff (XIII) | |
| 14 | 1.70 g | dyestuff (XVIII) | brown |
| | | 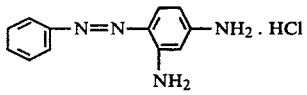 | |
| | 2.10 g | dyestuff (XII) | |
| | 0.55 g | dyestuff (XIII) | |
| 15 | 2.00 g | dyestuff (XIX) | brown |
| | | 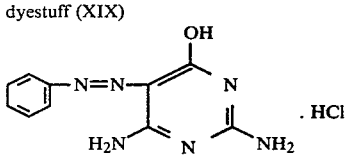 | |
| | 2.10 g | dyestuff (XII) | |
| | 0.55 g | dyestuff (XIII) | |
| 16 | 2.00 g | dyestuff (XX) | brown |
| | | 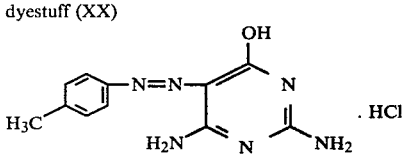 | |
| | 2.10 g | dyestuff (XII) | |
| | 0.55 g | dyestuff (XIII) | |
| 17 | 3.00 g | dyestuff (XXI) | yellowish brown |
| | | 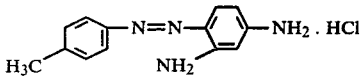 | |
| | 0.55 g | dyestuff (XIII) | |
| | 0.30 g | dyestuff (XIV) | |
| 18 | 2.00 g | dyestuff (XXII) | brown |
| | | 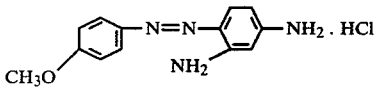 | |
| | 0.55 g | dyestuff (XIII) | |
| | 0.60 g | dyestuff (XIV) | |
| 19 | 6.00 | dyestuff (XVII) | blueish |
| | 2.10 g | dyestuff (XII) | green |
| | 2.60 g | dyestuff (XIII) | |
| 20 | 4.00 g | dyestuff (XI) | brown |
| | 6.30 g | dyestuff (XII) | |
| | 1.47 g | dyestuff (XIII) | |
| 21 | 1.40 g | dyestuff (XI) | dark |
| | 1.40 g | dyestuff (XII) | grey |
| | 1.84 g | dyestuff (XIII) | |
| 22 | 2.50 g | dyestuff (XIX) | olive |
| | 1.00 g | dyestuff (XXII) | |
| | 1.10 g | dyestuff (XIII) | |
| 23 | 2.50 g | dyestuff (XV) | olive |
| | 1.00 g | dyestuff (XXII) | |
| | 1.10 g | dyestuff (XIII) | |
| 24 | 2.50 g | dyestuff (XIX) | red |
| | 2.50 g | dyestuff (XXIII) | |

TABLE 2-continued

| Example | quantity of dyestuff used | dyestuff of formula | shade of the dyeing obtained |
|---|---|---|---|
| | | 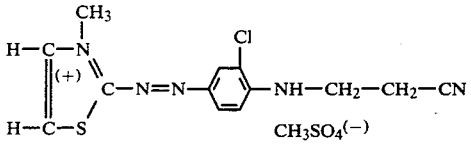 | |
| 25 | 3.00 g | dyestuff (XV) | blueish |
| | 1.25 g | dyestuff (XXIII) | green |
| | 1.84 g | dyestuff (XIII) | |
| 26 | 3.00 g | dyestuff (XVIII) | coffee- |
| | 1.75 g | dyestuff (XXIII) | brown |
| | 0.20 g | dyestuff (XIII) | |
| 27 | 2.00 g | dyestuff (XXI) | brown |
| | 1.40 g | dyestuff (XII) | |
| | 1.84 g | dyestuff (XIII) | |
| 28 | 0.50 g | dyestuff (XIX) | purple |
| | 0.75 g | dyestuff (XXIII) | |
| | 0.37 g | dyestuff (XIII) | |
| 29 | 1.00 g | dyestuff (XV) | green |
| | 0.25 g | dyestuff (XXIII) | |
| | 0.37 g | dyestuff (XIII) | |
| 30 | 1.00 g | dyestuff (XVIII) | grey |
| | 0.75 g | dyestuff (XXIII) | |
| | 0.74 g | dyestuff (XIII) | |

EXAMPLE 31

Yarn of a polyacrylonitrile fiber material with normal affinity properties is dyed in a laboratory scale dyeing machine, with dyeing beakers of stainless steel, in the following manner:

4 g of this yarn are introduced into 160 ml of an aqueous dyebath at 80° C. containing the following substances, in addition to water:

0.12 g of a retarding agent of formula

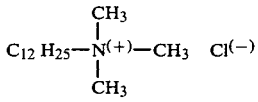

0.08 g of acetic acid (80% strength)

0.20 g of anhydrous sodium sulfate, 0.0004 g of the yellow dyestuff having the above mentioned formula (XI), 0.0012 g of the red dyestuff having formula (XXIV)

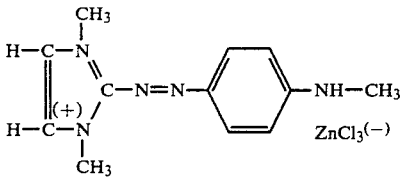

and 0.0001 g of the blue dyestuff of the above formula (B)

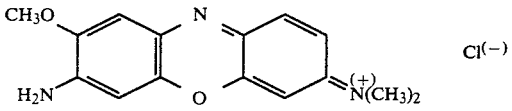

The dyebath is then heated to boiling within 30 minutes, and the dyeing process is continued for 60 minutes at a temperature of from 98° to 100° C. The dyebath is then cooled, the yarn removed and rinsed as usual. The result is a dyeing of a uniform and even light-brown shade.

EXAMPLE 32

12 kg of bulk yarn of a polyacrylonitrile fiber having high affinity properties are immersed into 420 l of an aqueous dyebath having a temperature of 80° C. containing the following compounds, in addition to water:

2.4 g of a retarding agent of formula

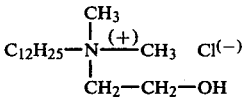

24 g of acetic acid (60% strength)

12 g of crystal sodium acetate, 120 g of anhydrous sodium sulfate, 0.60 g of the yellow dyestuff of formula (XXV)

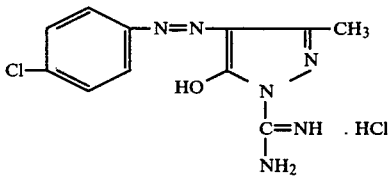

1.80 g of the red dyestuff of the above mentioned formula (A)

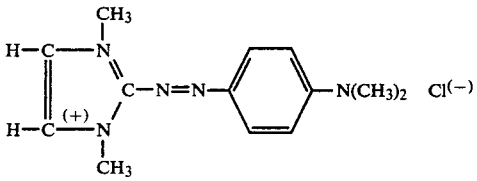

0.36 g of the blue dyestuff having the above-mentioned formula (B).

The dyebath is heated to 98° to 100° C. within 20 minutes after immersion of the fiber material, and the dyeing process is continued for 60 minutes at this temperature. The dyebath is subsequently cooled, the yarn freed from adhering dye liquor by centrifugation, rinsed as usual and dried. A dyeing of a perfectly uniform and even grey shade is obtained.

EXAMPLES 33 and 34

If the dyeing process is carried out as described in Example 1, but with the use of a dyestuff mixture specified in the following Examples instead of the dyestuff mixture mentioned in Example 1, dyeings are obtained which also show perfectly even and uniform shades.

| Ex. | quantity of dyestuff used | dyestuff of formula | shade of the dyeing obtained |
|---|---|---|---|
| 33 | 1.08 g | dyestuff (XXVI) 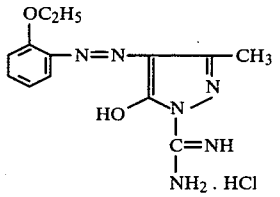 | green |
| | 0.035 g | dyestuff (XII) | |
| | 0.12 g | dyestuff (XIII) | |
| 34 | 1.13 g | dyestuff (XXVII) 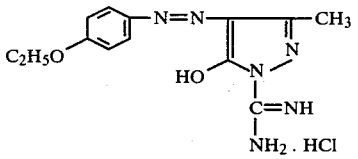 | green |
| | 0.035 g | dyestuff (XII) | |
| | 0.12 g | dyestuff (XIII) | |

What is claimed is:

1. In a polychromic (inclusive dichromic) dyeing process for the preparation of uniform dyeings on fiber materials of polyacrylonitrile wherein basic dyestuffs are applied on said fiber, the improvement consisting of using as a basic dyestuff a non-quaternized basic azo dyestuff selected from the dyestuffs of formulae (I) and (III)

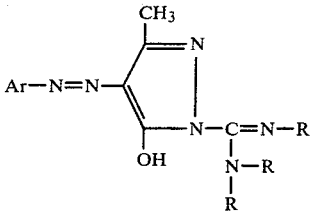

(I)

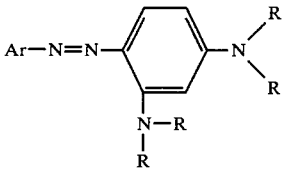

(III)

wherein Ar is phenyl or phenyl substituted by one or two substituents selected from the group consisting of chlorine, bromine, methyl, methoxy and ethoxy, and R, being identical or different from each other, each is hydrogen, methyl or ethyl.

2. The process according to claim 1, wherein one or several of said basic dyestuffs are used together with one or several, such as 2 or 3 or 4, quaternized, migrating cationic dyestuffs.

3. The process according to claim 1, wherein the dyeing process is carried out in the presence of an electrolyte and of a migrating cationic retarding agent.

4. The process according to claim 3, wherein, as a retarding agent, a compound of formula

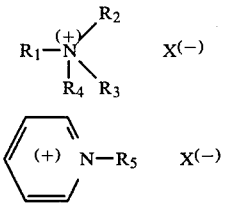

is used in which $R_1$ represents an alkyl radical having 6 to 14 carbon atoms, $R_2$, $R_3$ or $R_4$ being identical or different from one another, represent each an alkyl radical having 1 to 5 carbon atoms which may be substituted by a hydroxy group, $R_5$ stands for an alkyl radical having 8 to 16 carbon atoms and $X^{(-)}$ stands for an anion of an inorganic or organic acid.

5. The process for dyeing uniformly fibrous materials according to claim 1, which comprises treating a fibrous material of polyacrylonitrile with an aqueous, slightly acid solution of one or several of the basic azo dyestuffs defined in claim 1, at a temperature of from 20° to 120° C.

6. The process according to claim 5, wherein the aqueous dyestuff solution has a pH of from 3 to 6.5.

* * * * *